US007773889B2

(12) United States Patent
Okamura et al.

(10) Patent No.: US 7,773,889 B2
(45) Date of Patent: Aug. 10, 2010

(54) IMAGE FORMING APPARATUS AND METHOD OF SETTING THE SAME

(75) Inventors: Takehiko Okamura, Matsumoto (JP); Masaki Yuzawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 12/099,700

(22) Filed: Apr. 8, 2008

(65) Prior Publication Data

US 2009/0028582 A1 Jan. 29, 2009

(30) Foreign Application Priority Data

Apr. 9, 2007 (JP) ..... 2007-101264

(51) Int. Cl.
*G03G 15/00* (2006.01)

(52) U.S. Cl. ..... 399/12; 358/1.14

(58) Field of Classification Search ..... 399/12; 358/1.14

See application file for complete search history.

(56) References Cited

U.S. PATENT DOCUMENTS 7,050,726 B2 * 5/2006 Adkins et al. ..... 399/12
2008/0050129 A1 * 2/2008 Clarke et al. ..... 399/12

FOREIGN PATENT DOCUMENTS

| | | |
|---|---|---|
| JP | 2001-105625 | 4/2001 |
| JP | 2002278392 A | 9/2002 |
| JP | 2003266879 A | 9/2003 |
| JP | 2004-354923 | 12/2004 |
| JP | 2005-326731 | 11/2005 |
| JP | 2005-351958 | 12/2005 |
| JP | 2006-267601 | 10/2006 |

* cited by examiner

*Primary Examiner*—Constantine Hannaher
(74) *Attorney, Agent, or Firm*—Hogan Lovells US LLP

(57) ABSTRACT

An image forming apparatus can be so set as to allow or not to allow a low price consumable cartridge to operate with it. It can take a status where "00" is stored in the apparatus status recording memory thereof that allows it to be loaded with an ordinary toner cartridge or a low price toner cartridge supplied by the same manufacturer such that it operates normally when it is loaded with an ordinary toner cartridge but only limitedly when loaded with a low price toner cartridge and a status where 01 is stored in the apparatus status recording memory thereof so that it operates normally regardless if it is loaded with an ordinary toner cartridge or a low price toner cartridge.

4 Claims, 9 Drawing Sheets

| | apparatus status recording memory | |
|---|---|---|
| | 00 (=at time of initial shipment) | 01 (=at time of concluding agreement) |
| ordinary toner cartridge | normal operation | normal operation |
| low price toner cartridge | limited operation | normal operation |

FIG. 6

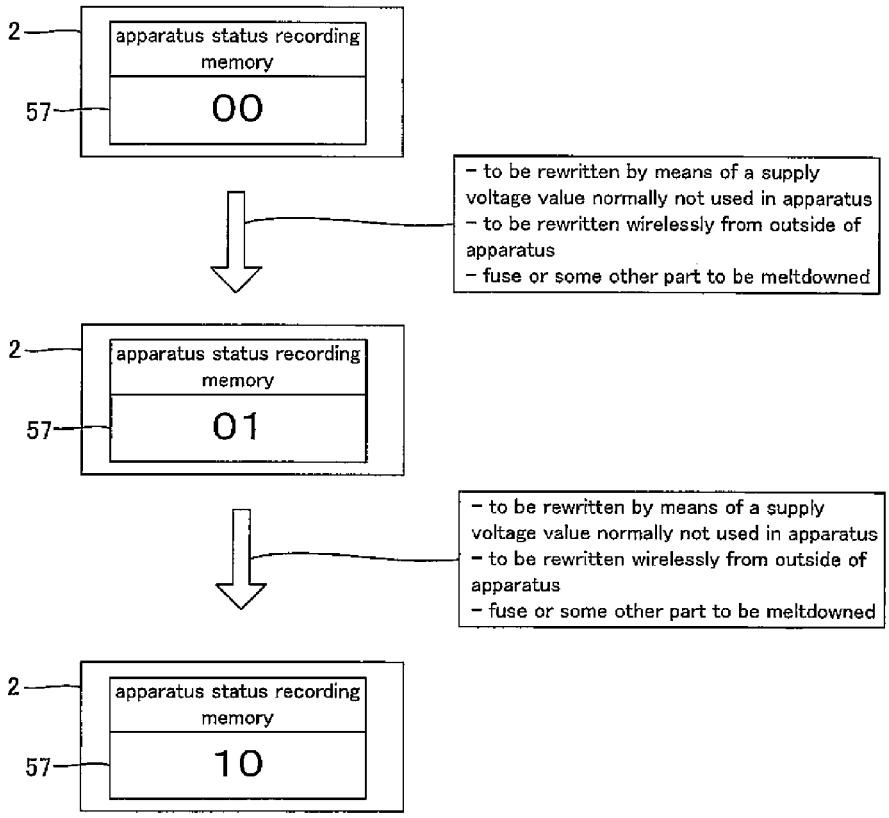

FIG. 7

| | apparatus status recording memory | | |
|---|---|---|---|
| | 00(=at time of initial shipment) | 01(=at time of concluding 1st agreement) | 10(=at time of concluding 2nd agreement) |
| ordinary toner cartridge | normal operation | normal operation | normal operation |
| first low price toner cartridge | limited operation | normal operation | normal operation |
| second low price toner cartridge | limited operation | limited operation | normal operation |

| | apparatus status recording memory | |
|---|---|---|
| | 00 (=at time of initial shipment) | 01 (=at time of concluding agreement) |
| ordinary toner cartridge | normal operation | normal operation |
| low price toner cartridge | limited operation | normal operation |
| improper toner cartridge | normal operation | limited operation |

IMAGE FORMING APPARATUS AND METHOD OF SETTING THE SAME

CROSS REFERENCE TO RELATED APPLICATION

This application is based upon and claims the benefit of priority from the prior Japanese Patent Application No. 2007-101264, filed on Apr. 9, 2007, the entire contents of which including the specifications, the drawings and the abstract thereof are incorporated herein by reference.

BACKGROUND OF THE INVENTION

1. Field of the Invention

This invention relates to a consumable cartridge that can be removably fitted to an image forming apparatus. More particularly, the present invention relates to an image forming apparatus provided with a functional feature of supporting sales and popularization of proper consumable cartridges and also to a method of setting such an image forming apparatus.

2. Description of the Related Art

Image forming apparatus such as electrophotographic copying machines, electrophotographic printers, electrophotographic facsimile machines, electrophotographic composite machines, ink-jet printers and ink-jet composite machines are generally equipped with a cartridge that is filled with toner, ink or some other consumable material and can be removably fitted to the apparatus. As the toner or the ink contained therein is completely gone, the consumable cartridge is replaced by a new one to supply the consumable material to the image forming apparatus.

It is highly desirable that such a consumable cartridge is a proper one that contains right toner or ink supplied by the manufacturer of the image forming apparatus or at least conforms the related standards that are provided by the manufacturer. This is because the performance of toner or ink directly affects the image quality of the image formed on a recording medium and, if a proper consumable cartridge is not used, there can arise problems such as that neither the coloring characteristics of the toner nor the ink and the color balance of the formed image are right and appropriate. Another reason is that toner and ink influence the mechanical structures such as the photosensitive drum of the image forming apparatus. In other words, the cartridge loaded in the image forming apparatus and the printing engine of the image forming apparatus can become out of order when the cartridge is loaded with proper toner or ink.

However, recently, many third parties who are not the manufacturers and the authorized vendors of image forming apparatus have been and are manufacturing and selling consumable cartridges that can be fitted to image forming apparatus. The toner and the ink filled in the consumable cartridge manufactured and sold by third venders may not conform to the standards of the coloring characteristics and the like provided by the manufactures. Thus, if a user puts a consumable cartridge filled with ink whose coloring characteristics differ from the standards into the main body of an image forming apparatus, the colors of the output image may not necessarily agree with the colors of the image displayed on the display screen of the host computer. When the cartridge is filled with low quality toner or ink, the image forming apparatus main body may fail at worst.

Therefore, there have been proposals for detecting improper consumable cartridges and outputting a predetermined warning or prohibiting any image forming operation when the use of an improper consumable cartridge is detected. For example, Patent Document 1 (JP 2001-105625-A) describes an ink cartridge monitoring system adapted to issue a warning when an ink cartridge that is not of the specified type is loaded in a printer. According to the above cited patent document, each ink cartridge to be loaded in a printer is made to contain an IC chip storing information on the cartridge recorded therein while the connector that is the interface with an IC chip, the EEPROM and the main control section of the printer are adapted to read the contained information. The host computer requests the printer for status information and, when an ink replacing flag is set in the response from the printer, it then requests the printer for the cartridge information. If the cartridge information provided in response does not indicate that the cartridge is a proper one, it transmits a warning message.

Patent Document 2 (JP 2005-326731-A) describes an image forming processing apparatus adapted to display a message notifying that the loaded toner cartridge is not a proper one on the UI apparatus when it is actually not a proper one and contains wrong toner and also an image prompting the user to make sure that the guarantee label guaranteeing the image quality is a wrong one in any operation mode other than the operation mode corresponding to a proper cartridge. Subsequently, the user is requested to display the guidance screen such as the selection screen of the proper operation mode on the UI apparatus.

SUMMARY OF THE INVENTION

In view of the actual status of consumable cartridges for image forming apparatus as described above, manufacturers of image apparatus and consumable cartridges have a desire of supporting sales and popularization of proper consumable cartridges as much as possible. Sales promotion strategies of providing consumable cartridges at discount prices to the clients who are committed to purchase proper consumable cartridges have been discussed. In the following description, low price consumable cartridges that are provided at discount prices are referred to as low price consumable cartridges.

Meanwhile, the sales strategy of providing low price consumable cartridges do not have any effect unless such low price consumable cartridges are adapted to operate properly only in the image forming apparatus belonging to the clients who are committed (agree) to purchase proper low price consumable cartridges. It is clear that the clients who are committed (agree) to use proper consumable cartridges do not get any advantage if low price consumable cartridges operate properly in the image forming apparatus belonging to the users who are not committed (agree) to use proper low price consumable cartridges.

However, there is a problem that no image forming apparatus that can be so set as to allow or not to allow a low price consumable cartridge to operate with it has been available to date.

According to the present invention, the above problem is dissolved by providing an image forming apparatus adapted to allow a first consumable and a second consumable to be loaded therein and take itself into a first status of operating properly when loaded with a first consumable but only limitedly when loaded with a second consumable or a second status of operating properly regardless of a first consumable or a second consumable loaded in it.

Preferably, in an image forming apparatus according to the present invention, both the first consumable and the second consumable are supplied by a same manufacturer.

Preferably, an image forming apparatus according to the present invention is additionally so adapted to allow a third consumable to be loaded therein and operate properly when loaded with a third consumable in a first status but only limitedly when loaded with a third consumable in a second status.

Preferably, in an image forming apparatus according to the present invention, both the third consumable is supplied by a manufacturer different from the manufacturer of the first consumable and the second consumable.

Preferably, in an image forming apparatus according to the present invention, the first status is shifted to the second status according to an agreement with the proprietor of the image forming apparatus.

Preferably, in an image forming apparatus according to the present invention, the first status is shifted to the second status by rewriting the key information on the memory of the apparatus.

Preferably, in an image forming apparatus according to the present invention, the key information on the memory is rewritten by means of a power supply voltage value that is normally not used in the apparatus.

Preferably, in an image forming apparatus according to the present invention, the key information on the memory is rewritten wirelessly from the outside of the apparatus.

Preferably, in an image forming apparatus according to the present invention, the first status is shifted to the second status by changing the physical profile of a component.

Preferably, in an image forming apparatus according to the present invention, the key information on the memory is rewritten by way of a network.

Preferably, in an image forming apparatus according to the present invention, the rewriting of the key information on the memory is triggered by the action of loading a second consumable. Preferably, in an image forming apparatus according to the present invention, the shift to the second status is irreversible.

In another aspect of the present invention, there is provided a method of setting an image forming apparatus adapted to allow a first consumable and a second consumable supplied by the manufacturer of the first consumable to be loaded therein into a first status of operating properly when loaded with a first consumable but only limitedly when loaded with a second consumable or a second status of operating properly regardless of a first consumable or a second consumable loaded in it.

Preferably, a method of setting an image forming apparatus according to the present invention is additionally so adapted to allow a third consumable supplied by a manufacturer different from the manufacturer of the first consumable and second consumable to be loaded in the apparatus and make it operate properly when loaded with a third consumable in a first status but only limitedly when loaded with a third consumable in a second status.

Thus, according to the present invention, there is provided an image forming apparatus that can be so set as to allow or not to allow a low price toner cartridge to operate with it

BRIEF DESCRIPTION OF THE DRAWINGS

FIG. 6 is a schematic illustration of the possible setting of the apparatus status recording memory 57 according to another embodiment of the present invention that is also a printer 2;

FIG. 7 is a schematic illustration of the corresponding relationship between the setting of the apparatus status recording memory 57 of the embodiment of FIG. 6 and an operable toner cartridge and a limitedly operable toner cartridge;

DETAILED DESCRIPTION OF THE PREFERRED EMBODIMENTS

Figure 1:
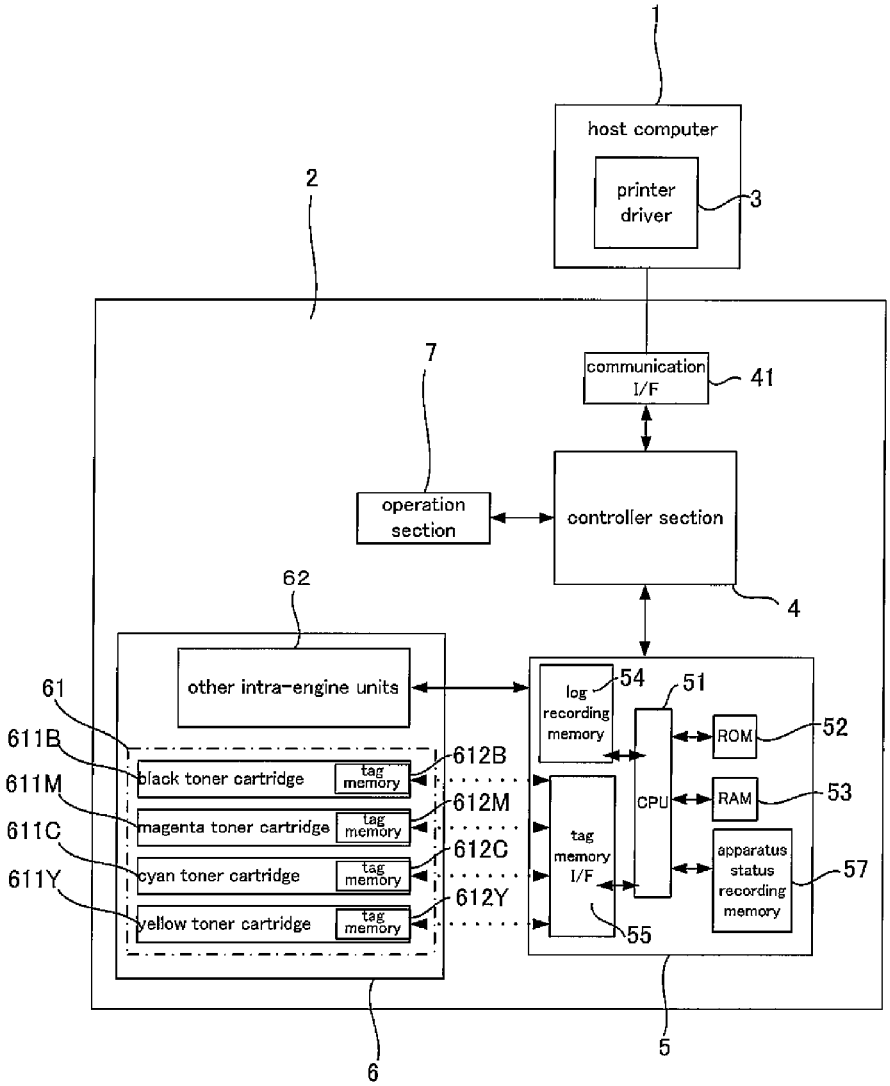
FIG. 1 is a schematic block diagram of a printer of an image forming apparatus according to an embodiment of the present invention.

Now, the first embodiment of image forming apparatus of the present invention, which is a printer, will be described by referring to the related drawing. FIG. 1 is a schematic block diagram of a printer of an image forming apparatus according to this embodiment of the present invention. The printer 2 of this embodiment of the present invention operates to form an image on a predetermined printing medium according to a printing request from a host computer 1 (host apparatus). The printer 2 can be loaded with toner cartridges 611 (development units) of four colors. Then, it forms an image, using the toners of four colors so as to sequentially lay different colors on the printing medium according to the above printing request.

The host computer 1 shown in FIG. 1 is a host apparatus that issues a printing request to the printer 2 by way of a communication I/F 41 belonging to the printer 2. It transmits printing data including image data and control command to the printer 2 according to a user operation. The host computer 1 may be a so-called personal computer. While the printer 2 is connected to the host computer 1 in FIG. 1, it may alternatively be connected to a plurality of host apparatus by way of a network. If such is the case, the communication I/F 41 may be a known interface means such as a 100BASE-TX/10BASE-T Multi-Protocol Ethernet (tradename) interface or a HI-SPEED USE (USB 2.0) interface. The printer driver 3 in the host computer 1 receives data typically from an application (not shown) in the host computer 1 and generates the printing data to be transmitted to the printer 2.

As shown in FIG. 1, the printer 2 includes a controller section 4, an engine control section 5, an engine 6 and an operation section 7. The controller section 4 receives the printing data transmitted from the host computer 1. Then, it interprets the control command contained in the data and also executes a predetermined process on the image data contained in the data to generate the data to be provided to the engine 6. Although not shown, the controller section 4 includes a CPU and an image memory, which image memory stores the data generated in a manner as described above. Additionally, when a predetermined any of data are generated in the image memory, the controller section 4 transmits information telling the engine control section 5 to start a development operation.

As shown in FIG. 1, the engine control section 5 includes a CPU 51, a ROM 52, a RAM 53, a log recording memory 54, a tag memory I/F 55 and an apparatus status recording memory 57. The CPU 51 controls the components of the engine 6. Additionally, the CPU 51 reads the information from the tag memories 612 arranged in the toner cartridges 611 by way of the tag memory I/F 55 and then it executes a process and makes a determination according to the information. The log recording memory 54 is a nonvolatile memory of a known type that stores information relating to the toner cartridges 611 that have been loaded in the printer 2. The ROM 52 stores various programs for controlling the printer 2 and the RAM 53 temporarily stores various pieces of information relating to the printer 2. The tag memory I/F 55 is an interface for the CPU 51 and the tag memories 612 in the toner cartridges. It is used typically when the CPU 51 reads the information written in the memories 612 in the toner cartridges and writes it in the log recording memory 54. The apparatus status recording memory 57 stores data that tells the types of toner cartridges the printer 2 can use. The apparatus status recording memory 57 will be described in greater detail hereinafter.

Figure 2:
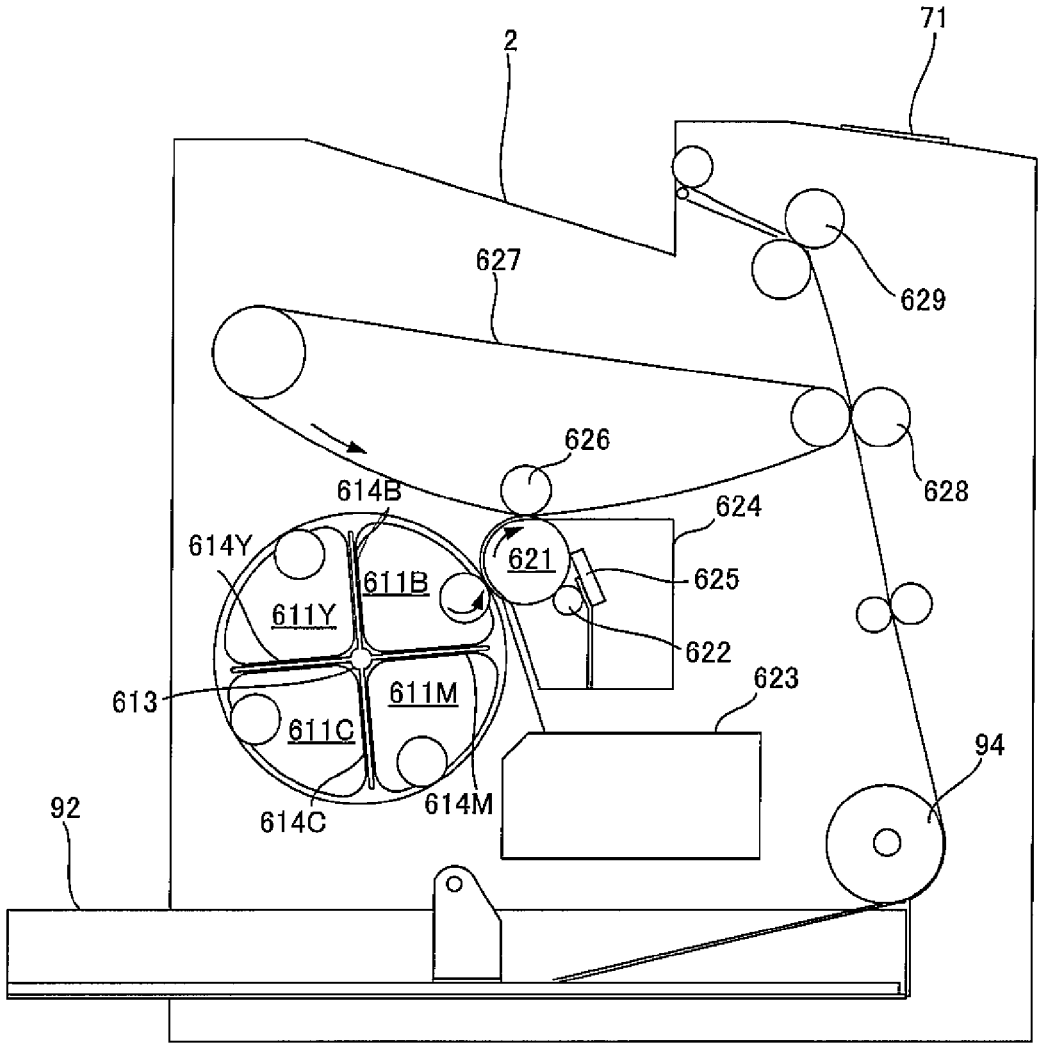
FIG. 2 is a schematic cross-sectional view of a principal part of the printer 2 of the embodiment of FIG. 1, centered at the mechanism of the engine 6 thereof.

The engine 6 includes a charging unit, an exposure unit, a development apparatus and a transfer unit. In FIG. 1, there are only shown the development apparatus 61 (development means) and other intra-engine units 62. FIG. 2 is a schematic cross-sectional view of a principal part of the printer 2 of this embodiment, centered at the mechanism of the engine 6 thereof.

The photosensitive drum 621 has a cylindrical conductive base member and a photosensitive layer formed on the outer peripheral surface of the base member. It can rotate around a central axis clockwise as indicated by an arrow in FIG. 2. The charging unit 622 is adapted to electrically charge the photosensitive drum 621 and the exposure unit 623 irradiates a beam on to the electrically charged photosensitive drum 621 from a light source such as a laser or an LED array to form an electrostatic latent image on the photosensitive drum 621. The operation of the exposure unit 623 of irradiating a beam is controlled by a drive signal that is modulated according to the image information input from the host computer 1.

The development apparatus 61 includes loading sections 614B through 614Y that are removably loaded with a black toner cartridge 611B, a magenta toner cartridge 611M, a cyan toner cartridge 611C and a yellow toner cartridge 611Y. It is a development rotary that can rotate around a central axis 613. A latent image on the photosensitive drum 621 is developed to a visible image by means of developing agent as the development apparatus 61 is driven to rotate so as to bring the required one of the toner cartridges 611B through 611Y close to the photosensitive drum 621 and the developing agent is supplied to the photosensitive drum 621 carrying the latent image.

The toner cartridges 611 are provided with respective tag memories 612B through 612Y that are typically non-contact type nonvolatile memories, each of which stores information on the color and the remaining quantity of the developing agent contained in the corresponding toner cartridge so that the printer 2 recognizes statuses of the toner cartridge 611B loaded in the development apparatus 61. As power source is turned on or toner cartridges 611 are loaded in the development apparatus 61, the information of each of the tag memories 612 is read out by the printer 2. After each developing operation, the information on the remaining quantity stored in the each of the tag memories 612 of the toner cartridge 611 is updated. Each of the toner cartridge memories 612 may also store various other pieces of information such as information relating to the toner type of the toner contained in the toner cartridge 611. It may be so arranged that the tag memory I/F 55 of the engine control section 5 and the tag memories 612B through 612Y communicate with each other wirelessly in a non-contact manner. Alternatively, it may be so arranged that the tag memory I/F communicates with the tag memories 612B through 612Y by way of wire. According to the present invention, each of the tag memories 612B through 612Y of the toner cartridges 611 also stores information telling that the toner cartridge 611 is an ordinary toner cartridge or that the toner cartridge 611 is a low price toner cartridge.

The primary transfer unit 623 transfers the toner image formed on the photosensitive drum 621 onto an intermediate transfer body 627. The intermediate transfer body 627 is an endless belt produced by forming an aluminum deposited layer on the surface of a belt of PET film and applying a semiconductor paint to the surface of the aluminum layer. It is driven to rotate at a speed same as the peripheral speed of the photosensitive drum 621. The printing medium that is typically a sheet of paper supplied from a sheet feeding cartridge 92 is conveyed to a secondary transfer unit 628 and then to a fixing unit 629 by way of a sheet feeding roller 94. The secondary transfer unit 628 transfers the toner image formed on the intermediate transfer body 627 onto the printing medium supplied from the sheet feeding cartridge 92 and the fixing unit 629 fixes the toner image transferred onto the printing medium to the medium to turn it into a permanent image. The printing medium now carrying a permanent image is discharged to the outside of the printer 2.

A cleaning unit 624 is arranged between the primary transfer unit 626 and the charging unit 622 and has a cleaning blade 625 to be brought into contact with the surface of the photosensitive drum 621 in order to remove the developing agent (toner) remaining on the photosensitive drum 621 after the primary transfer operation. The operation section 7 (operation means) shown in FIG. 1 is a part by which the user operates the printer 2. It typically includes an operation display panel 71 and operation buttons. Devices such as a touch panel is arranged on the operation display panel 71 and the user can operate the printer 2 by directly touching the operation display panel 71, referring to the UI (user interface) displayed on the operation display panel 71. The user can perform various setting operations such as selecting printing conditions for the printer 2 by means of the operation section 7.

Now, the types of toner cartridges 611 that can be used in the printer 2 having the above-described configuration will be described below. There are two types of toner cartridges 611 that are supplied by the manufacturer of the printer 2. The two types include ordinary toner cartridges and low price toner cartridges. Low price toner cartridges are priced lower than ordinary toner cartridges. They are sold only to the clients who have entered into an agreement of using only toner cartridges supplied by the manufacturer of the printer 2.

The sales strategy of the printer manufacturer does not have any effect unless such low price toner cartridges adapted to operate only in the printers 2 owned by the clients who have entered into an agreement of using proper low price toner cartridges. The clients who have entered into an agreement of using only toner cartridges supplied by the printer manufacturer do not get any advantage if such low price toner cartridges operate properly in the image forming apparatus belonging to the users who have not entered into an agreement of using only toner cartridges supplied by the printer manufacturer.

Thus, according to the present invention, the apparatus status recording memory 57 of the printer 2 is made to store information telling if the printer 2 can use only ordinary toner cartridges or it can use low price toner cartridges as well as ordinary toner cartridges.

Figures 3, 4:
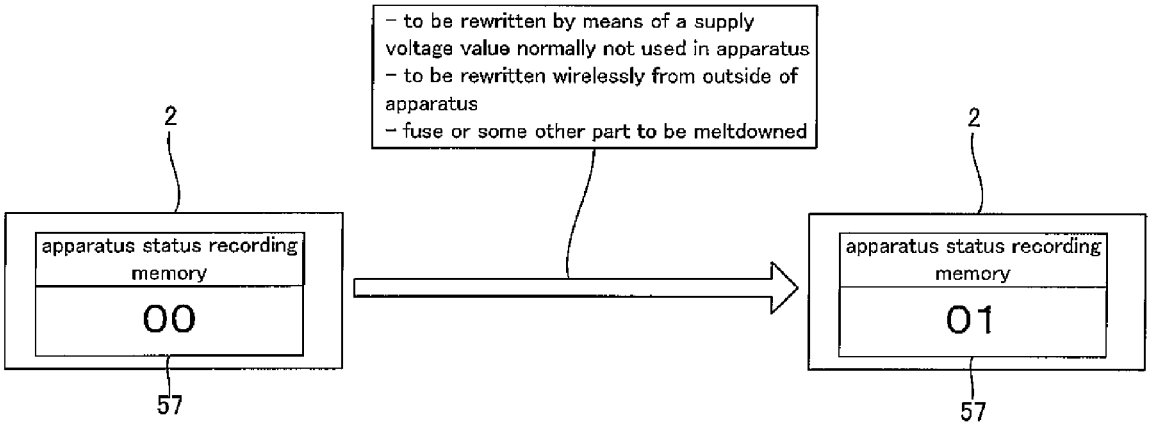
FIG. 3 is a schematic illustration of the possible setting of the apparatus status recording memory 57 of the printer 2 of the embodiment of FIG. 1.
FIG. 4 is a schematic illustration of the corresponding relationship between the setting of the apparatus status recording memory 57 of the embodiment of FIG. 1 and an operable toner cartridge and a limitedly operable toner cartridge.

FIG. 3 is a schematic illustration of the possible setting of the apparatus status recording memory 57 of the printer 2 of this embodiment. The printer manufacturer typically sets 00 in the apparatus status recording memory 57 at the time of shipment from the manufacturing plant (at time of initial shipment). Then, the printer manufacturer enters into an agreement as shown below with the client, or the owner of the printer 2.

The manufacturer supplies low price toner cartridges to the proprietor of the printer 2.

The proprietor of the printer 2 shall not use improper toner cartridges.

Proper toner cartridges at least include genuine toner cartridges supplied by the manufacturer of the printer. They are standardized toner cartridges and appropriate toner cartridges that are manufactured and sold by the manufacturer so as to be used in the printer and whose qualities are guaranteed by the manufacturer and equivalent toner cartridges whose qualities are also guaranteed in some way or another. Improper toner cartridges are toner cartridges other than proper toner cartridges whose qualities are not guaranteed if used in the printer 2.

Then, "01" is typically set in the apparatus status recording memory 57 of the printer 2 owned by the client who has entered into such an agreement. It is desirable that a special operation is required to rewrite the key information of the apparatus status recording memory 57 and it can be conducted only by the service person who takes care of the printer 2. For example, there may be a technique of setting the printer 2 so as to rewrite key information of the apparatus status recording memory 57 from a special connector on a board (not shown) of the printer 2, using a power supply voltage value that is not used in ordinary printers 2. When such a technique is employed, an exclusive onetime memory or a onetime region of an existing LSI may be used and the printer 2 may further be so set that the key information can be rewritten only once.

Beside the use of a port of a special controller as described above, it may alternatively be so arranged that the key information of the apparatus status recording memory 57 can be rewritten by utilizing a known port of an Ethernet interface or a USB interface.

Still alternatively, an RF-ID may be arranged for the apparatus status recording memory 57 so that the printer 2 can be rewritten wirelessly from the outside of the printer 2 by means of a special protocol or a cipher that only the manufacturer of the printer 2 knows. Once again, with such an arrangement, the printer 2 may further be so set that the key information can be irreversibly rewritten only once.

Still alternatively, the apparatus status recording memory 57 may be formed by using a fuse or some other part, which is meltdowned when the setting is changed from "00" to "01" because what is essential for the apparatus status recording memory 57 is that it stores "00" or "01". An apparatus status recording memory 57 formed by using a fuse or some other similar part makes the setting of the printer 2 inevitably irreversible.

Now, the operation of the printer 2 based on the apparatus status recording memory 57 that is set in a manner as described above will be described below. FIG. 4 is a schematic illustration of the corresponding relationship between the setting of the apparatus status recording memory 57 of the embodiment and an operable toner cartridge and a limitedly operable toner cartridge.

According to the present invention, if the engine G of the printer 2 can be operated normally or only limitedly is determined according to the corresponding relationship between the setting of the apparatus status recording memory 57 of the printer 2 and the toner cartridge loaded in the printer 2.

When the printer 2 is shipped from the manufacturing plant of the manufacturer, the apparatus status recording memory 57 is set to "00". This means that the engine 6 can operate normally when an ordinary toner cartridge is loaded in the printer 2 but operate only limitedly when a low price toner cartridge is loaded therein. On the other hand, when the client who purchased the printer 2 has entered into an agreement and the setting of the apparatus status recording memory 57 is rewritten so as to read "01", the engine 6 is disposed so as to operate normally regardless if an ordinary toner cartridge is loaded or a low price toner cartridge is loaded in the printer 2.

Figure 5:
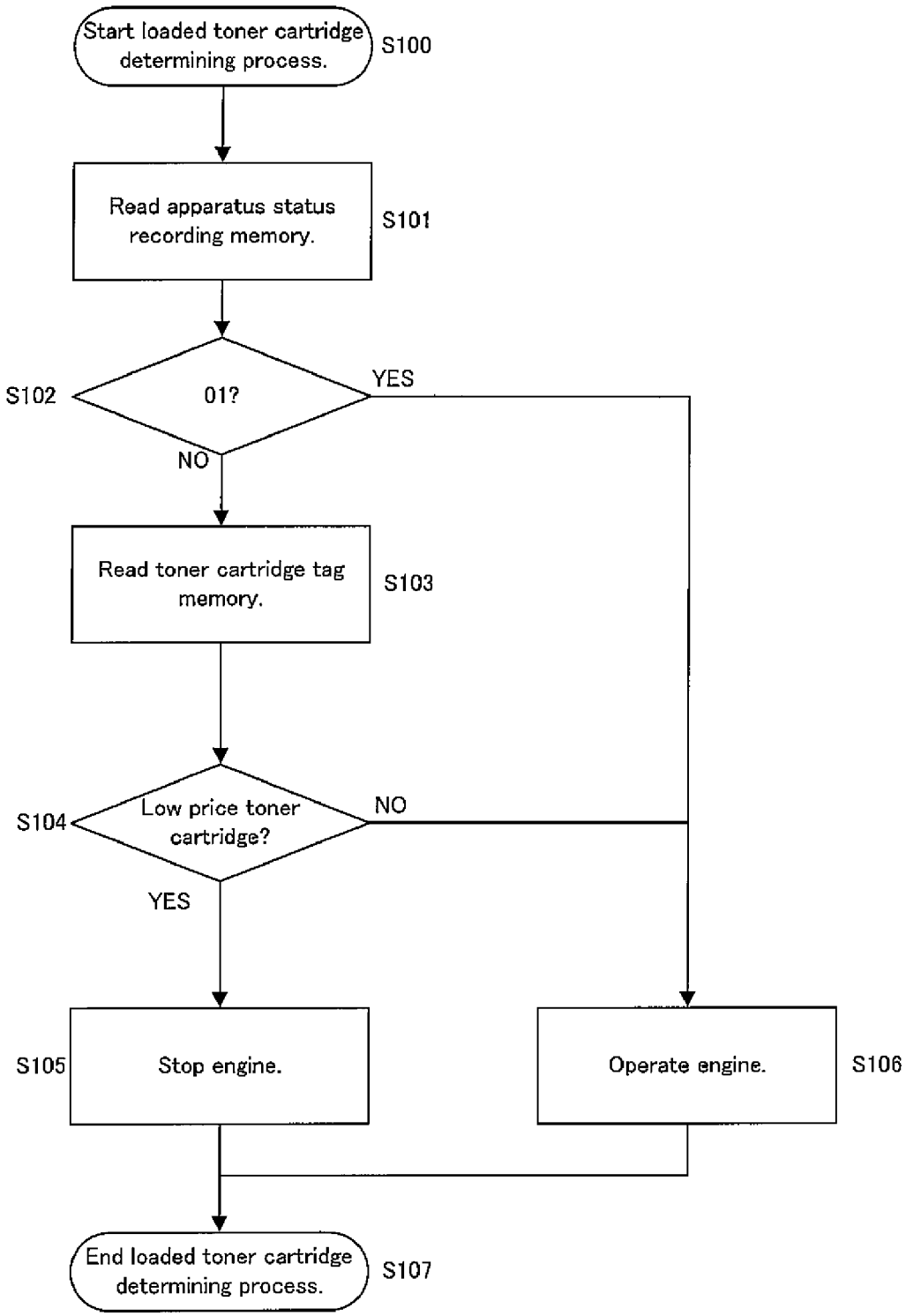
FIG. 5 is a control flowchart of the engine control section 5 of the printer 2 of the embodiment of FIG. 1.

Now, the operation of engine control sections that responds to a loaded toner cartridge will be described below. FIG. 5 is a control flowchart of the engine control section 5 of the printer 2 of this embodiment.

Referring to the flowchart of FIG. 5, as the loaded toner cartridge determination process is started in Step S100, the control section 5 proceeds to the next step, or Step S101, where it reads the value stored in the apparatus status recording memory 57. Subsequently, in Step S102, it is determined if the read value is "01" or not. If it is determined that the read value is "01" (YES), the control section 5 proceeds to Step S106, where it operates the engine 6, and then to Step S107 to end the process.

If, on the other hand, NO is determined in Step S102, the control section 5 then proceeds to Step S103, where it reads the tag memory of the toner cartridge 611. As described above, the tag memory stores information telling if the toner cartridge is an ordinary toner cartridge or a low price toner cartridge.

In Step S104, it is determined if the loaded toner cartridge is a low price toner cartridge or not. If NO is determined in Step S104, the control section 5 proceeds to Step S106, where it operates the engine 6, and then to Step S107 to end the process.

If, on the other hand, YES is determined in Step S104, it becomes clear that the printer 2 belongs to a client who has not entered into an agreement but a low price toner cartridge is loaded in the printer 2. Then, the control section 5 proceeds to Step S105, where it stops the engine 6. Subsequently, the control section 5 proceeds to Step S107 to end the process.

As described above, according to the present invention, there is provided an image forming apparatus that can be so set as to allow or not to allow a low price consumable cartridge to operate with it Now, the second embodiment of image forming apparatus according to the present invention, which is also a printer 2, will be described below by referring to the related drawings.

The types of toner cartridge 611 that the printer 2 of the second embodiment can use will be described below. Toner cartridges 611 that the manufacturer of the printer 2 supplies for this embodiment include three types including ordinary toner cartridge, first low price toner cartridges and second low price toner cartridges. The first low price toner cartridge is priced lower than the ordinary toner cartridge and the second low price toner cartridge is priced lower than the first low price toner cartridge.

First low price toner cartridges are sold only to the clients, each of whom has entered into an agreement of using only toner cartridges supplied by the manufacturer of the printer 2 belonging to the client. Second low price toner cartridges are provided to the clients who have been using first low price toner cartridges for a long period of time at a price lower than first low price toner cartridges as a reward for the long use.

The sales strategy of the printer manufacturer does not have any effect unless such low price first toner cartridges and second low price toner cartridges adapted to operate only in the printers 2 owned by the clients who have entered into an agreement of using proper low price toner cartridges. The clients who have entered into an agreement of using only toner cartridges supplied by the printer manufacturer do not get any advantage if such low price toner cartridges operate properly in the image forming apparatus belonging to the users who have not entered into an agreement of using only toner cartridges supplied by the printer manufacturer. Additionally, the printer 2 of this embodiment needs to be so arranged as to determine if the toner cartridge loaded in it is a first low price toner cartridge or a second low price toner cartridge.

Thus, according to the present invention, the apparatus status recording memory 57 of the printer 2 is made to store information telling if the printer 2 can use only ordinary toner cartridges, it can use first low price toner cartridges as well as ordinary toner cartridges or it can use first and second low price toner cartridges as well as ordinary toner cartridges FIG. 6 is a schematic illustration of the possible setting of the apparatus status recording memory 57 of the printer 2 of this embodiment. The printer manufacturer typically sets 00 in the apparatus status recording memory 57 at the time of shipment from the manufacturing plant (at time of initial shipment). Then, the printer manufacturer enters into a first agreement as shown below with the client, or the owner of the printer 2.

The manufacturer supplies first low price toner cartridges to the proprietor of the printer 2.

The proprietor of the printer 2 shall not use improper toner cartridges.

Then, second low price toner cartridges are provided to the clients who have been using first low price toner cartridges for a long period of time at a price lower than first low price toner cartridges as a reward for the long use. For providing second low price toner cartridges, the printer manufacturer enters into a second agreement as shown below with the client, or the owner of the printer 2 who is a long user.

The manufacturer supplies second low price toner cartridges to the proprietor of the printer 2.

The proprietor of the printer 2 shall not use improper toner cartridges.

Proper toner cartridges at least include genuine toner cartridges supplied by the manufacturer of the printer 2. They are standardized toner cartridges and appropriate toner cartridges that are manufactured and sold by the manufacturer so as to be used in the printer 2 and whose qualities are guaranteed by the manufacturer and equivalent toner cartridges whose qualities are also guaranteed in some way or another. Improper toner cartridges are toner cartridges other than proper toner cartridges whose qualities are not guaranteed it used in the printer 2.

Then, 01 is typically set in the apparatus status recording memory 57 of the printer 2 owned by the client who has entered into such a first agreement. Similarly, 10 is typically set in the apparatus status recording memory 57 of the printer 2 owned by the client who has entered into such a second agreement.

In this embodiment again, it is desirable that a special operation is required to rewrite the key information of the apparatus status recording memory 57 and it can be conducted only by the service person who takes care of the printer 2. For example, there may be a technique of setting the printer 2 so as to rewrite key information of the apparatus status recording memory 57 from a special connector on a board (not shown) of the printer 2, using a power supply voltage value that is not used in ordinary printers. When such a technique is employed, an exclusive onetime memory or a onetime region of an existing LSI may be used and the printer 2 may further be so set that the key information can be rewritten only once.

Beside the use of a port of a special controller as described above, it may alternatively be so arranged that the key information of the apparatus status recording memory 57 can be rewritten by utilizing a known port of an Ethernet interface or a USB interface.

Still alternatively, an RF-ID may be arranged for the apparatus status recording memory 57 so that the printer 2 can be rewritten wirelessly from the outside of the printer 2 by means of a special protocol or a cipher that only the manufacturer of the printer 2 knows. Once again, with such an arrangement, the printer 2 may further be so set that the key information can be irreversibly rewritten only once.

Still alternatively, the apparatus status recording memory 57 may be formed by using a fuse or some other part, which is meltdowned when the setting is changed from "00" to "01" or from "01" to "10" because what is essential for the apparatus status recording memory 57 is that it stores "00", "01" or "10". An apparatus status recording memory 57 formed by using a fuse or some other similar part makes the setting of the printer 2 inevitably irreversible.

Now, the operation of the printer 2 based on the apparatus status recording memory 57 that is set in a manner as described above will be described below. FIG. 7 is a schematic illustration of the corresponding relationship between the setting of the apparatus status recording memory 57 of the embodiment and an operable toner cartridge and a limitedly operable toner cartridge.

According to the present invention, if the engine 6 of the printer 2 can be operated normally or only limitedly is determined according to the corresponding relationship between the setting of the apparatus status recording memory 57 of the printer 2 and the toner cartridge loaded in the printer 2.

When the printer 2 is shipped from the manufacturing plant of the manufacturer, the apparatus status recording memory 57 is set to "00". This means that the engine 6 can operate normally when an ordinary toner cartridge is loaded in the printer 2 but operate only limitedly when a first low price toner cartridge or a second low price toner cartridge is loaded therein. On the other hand, when the client who purchased the printer 2 has entered into a first agreement and the setting of the apparatus status recording memory 57 is rewritten so as to read "01", the engine 6 is disposed so as to operate normally when an ordinary toner cartridge or a first low price toner cartridge is loaded. However, when the setting of the apparatus status recording memory 57 is "01", the engine 6 is disposed so as to operate only limitedly when a second low price toner cartridge is loaded in the printer 2. Thereafter, when the client has entered into a second agreement and the setting of the apparatus status recording memory 57 is rewritten so as to read "10", the engine 6 is disposed so as to operate normally regardless if an ordinary toner cartridge is loaded, a first low price toner cartridge is loaded or a second low price toner cartridge is loaded in the printer 2.

Figure 8:
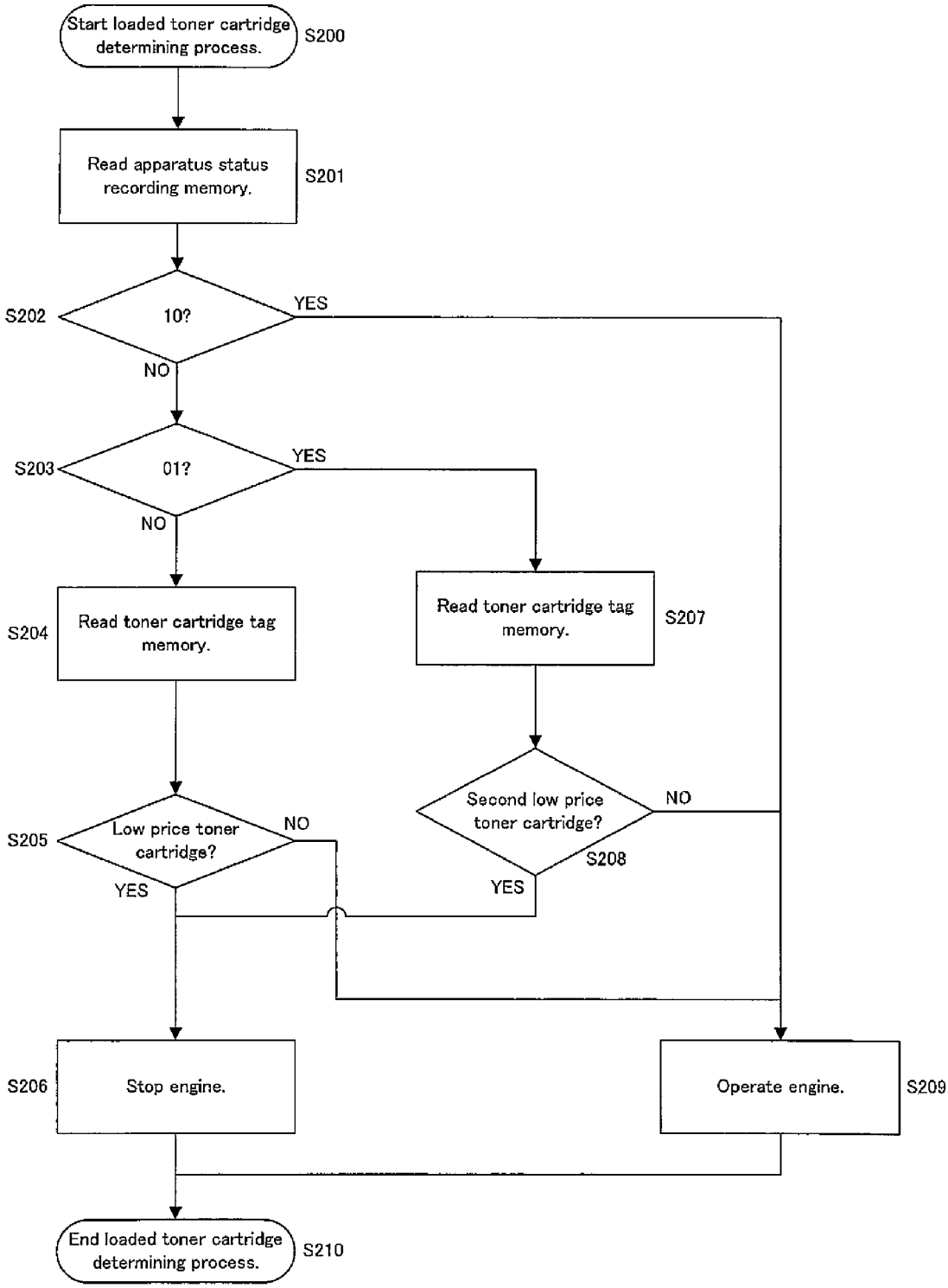
FIG. 8 is a control flowchart of the engine control section 5 of the printer 2 of the embodiment of FIG. 6.

Now, the operation of engine control section 5 that responds to a loaded toner cartridge will be described below. FIG. 8 is a control flowchart of the engine control section 5 of the printer 2 of this embodiment.

Referring to the flowchart of FIG. 8, as the loaded toner cartridge determination process is started in Step S200, the control section 5 proceeds to the next step, or Step S201, where it reads the value stored in the apparatus status recording memory 57. Subsequently, in Step S202, it is determined if the read value is "10" or not. If it is determined that the read value is "10" (YES), the control section 5 proceeds to Step S209, where it operates the engine 6, and then to Step S210 to end the process.

If, on the other hand, NO is determined in Step S202, the control section 5 then proceeds to Step S203, where it is determined if the value read in Step S203 is "01" or not. If it is determined that the read value is "01" (YES), the control section 5 proceeds to Step S207, where it reads the tag memory of the toner cartridge 611. As described above, the tag memory stores information telling if the toner cartridge is an ordinary toner cartridge or a low price toner cartridge.

In Step S208, it is determined if the loaded toner cartridge is a second low price toner cartridge or not. If NO is determined in Step S208, the control section 5 proceeds to Step S209, where it operates the engine 6, and then to Step S210 to end the process.

If, on the other hand, YES is determined in Step S208, it becomes clear that the printer 2 belongs to a client who has not entered into a second agreement but a second low price toner cartridge is loaded in the printer 2. Then, the control section 5 proceeds to Step S206, where it stops the engine 6. Subsequently, the control section 5 proceeds to Step S210 to end the process.

If it is determined that the value read in Step S203 is not "01" (NO), the control section 5 proceeds to Step S204, where it reads the tag memory of the toner cartridge 611. Then, in Step S205, it is determined if the loaded toner cartridge is a low price toner cartridge regardless if it is a first low price toner cartridge or a second low price toner cartridge. If NO is determined in Step S205, the control section 5 proceeds to Step S209, where it operates the engine 6, then to Step S210 to end the process.

If, on the other hand, YES is determined in Step S 205, it becomes clear that the printer 2 belongs to a client who has not entered into an agreement but a first or second low price toner cartridge is loaded in the printer 2. Then, the control section 5 proceeds to Step S205, where it stops the engine 6. Subsequently, the control section 5 proceeds to Step S210 to end the process.

As described above, according to the present invention, there is provided an image forming apparatus that can be so set as to allow or not to allow a first low price toner cartridge and/or a second low price toner cartridge to operate with it.

While the manufacturer of the printer 2 supplies ordinary toner cartridges, first low price toner cartridges and second low price toner cartridges in the above description of the second embodiment, it may be needless to say that an image forming apparatus can be so arranged that it can discriminate an ordinary toner cartridge, a first low price toner cartridge, a second low price toner cartridge, . . . , an n-th low price toner cartridge.

Figure 9:
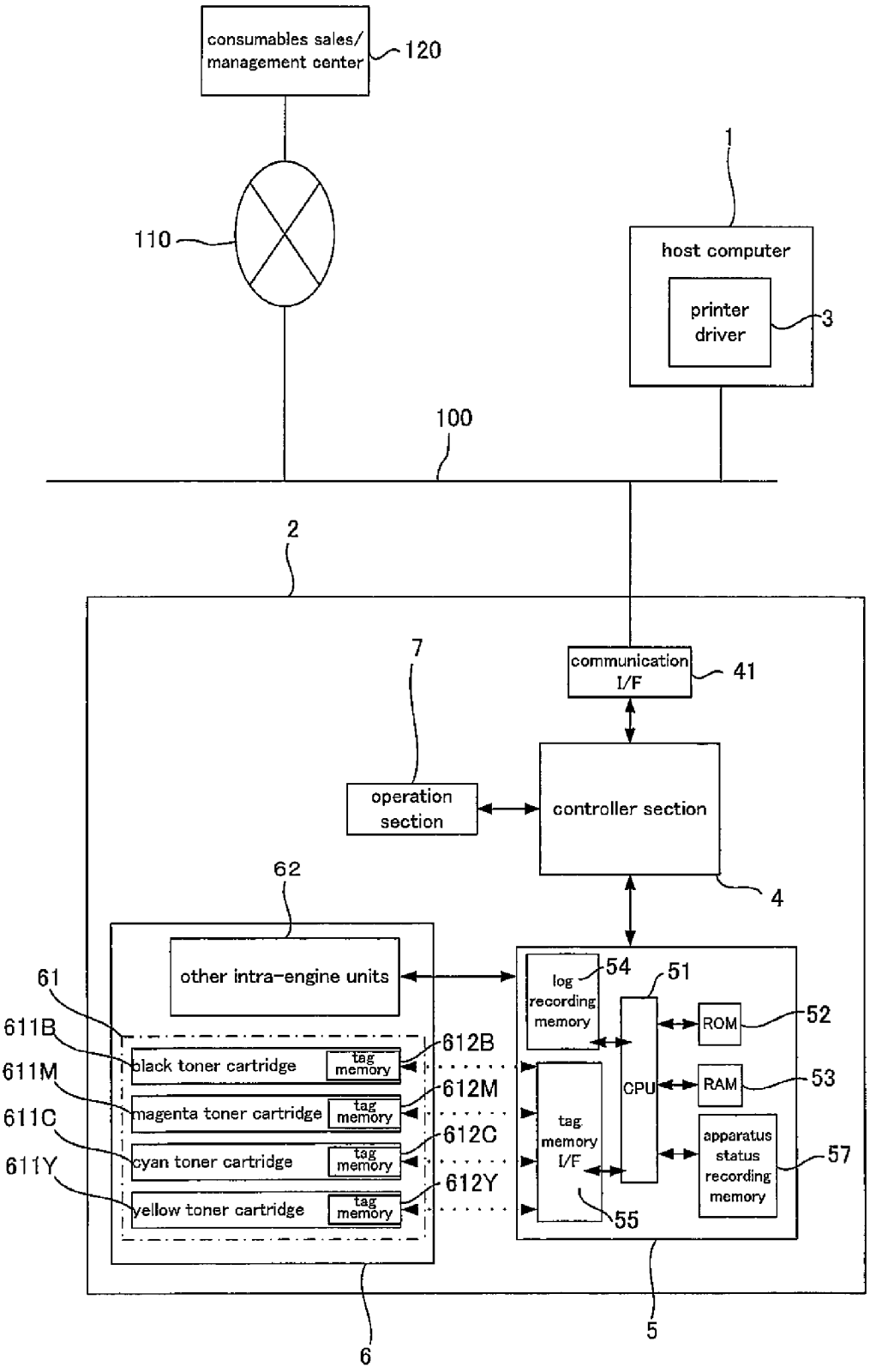
FIG. 9 is a schematic block diagram of a printer of an image forming apparatus according to still another embodiment of the present invention.

Now, the third embodiment of image forming apparatus according to the present invention will be described by referring to the related drawings. This embodiment is also a printer. FIG. 9 is a schematic block diagram of this embodiment of image forming apparatus. The arrangement of FIG. 9 differs from that of FIG. 1 in that the printer 2 and the host computer 1 of the client are connected to each other by way of a network 100, which may be a LAN or a WAN. The arrangement of FIG. 9 further differs from that of FIG. 1 in that the network 100, which may be a LAN or a WAN, is further connected to a communication network 110 such as the Internet so that the printer 2 is communicably connected to consumable sales center 120 that sells and manages consumables such as toner cartridges. The relationship between the consumable sales center 120 and the printer 2 will be described in greater detail hereinafter.

Assume that the toner cartridges 611 supplied by the manufacturer of the printer 2 includes two types, ordinary toner cartridges and low price toner cartridges. Low price toner cartridges are priced lower than ordinary toner cartridges and when an improper toner cartridge is loaded into the nuclear reactor 2, the operation of the printer 2 is restricted. Therefore, improper toner cartridges will be described below. Proper toner cartridges at least include genuine toner cartridges supplied by the manufacturer of the printer 2. They are standardized toner cartridges and appropriate toner cartridges that are manufactured and sold by the manufacturer so as to be used in the printer 2 and whose qualities are guaranteed by the manufacturer and equivalent toner cartridges whose qualities are also guaranteed in some way or another. Improper toner cartridges are toner cartridges other than proper toner cartridges whose qualities are not guaranteed if used in the printer 2.

Low price toner cartridges are priced lower than ordinary toner cartridges. They are sold only to the clients who have entered into an agreement of using only toner cartridges supplied by the manufacturer of the printer 2. This embodiment is so adapted that the manufacturer of the printer 2 and the client enter into an agreement that the manufacturer supplies the client with low price toner cartridges and the client does not use any improper toner cartridges in return.

The sales strategy of the printer manufacturer does not have any effect unless such low price toner cartridges adapted to operate only in the printers 2 owned by the clients who have entered into an agreement of using proper low price toner cartridges. The clients who have entered into an agreement of using only toner cartridges supplied by the printer manufacturer do not get any advantage if such low price toner cartridges operate properly in the image forming apparatus belonging to the users who have not entered into an agreement of using only toner cartridges supplied by the printer manufacturer. This embodiment is realized by taking any possible use of improper toner cartridges into consideration in order to make the sales strategy of providing low price toner cartridges more effective.

Thus, in this embodiment again, the apparatus status recording memory 57 of the printer 2 is made to store information telling if the printer 2 can use only ordinary toner cartridges or it can use low price toner cartridges as well as ordinary toner cartridges.

Figures 10, 11:
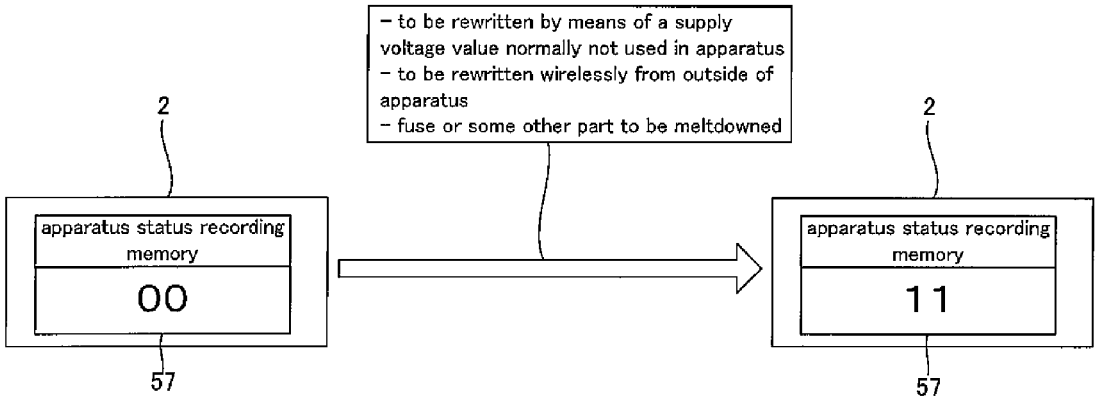
FIG. 10 is a schematic illustration of the possible setting of the apparatus status recording memory 57 of the embodiment of FIG. 9.
FIG. 11 is a schematic illustration of the corresponding relationship between the setting of the apparatus status recording memory 57 of the embodiment of FIG. 9 and an operable toner cartridge and an limitedly operable toner cartridge.

FIG. 10 is a schematic illustration of the possible setting of the apparatus status recording memory 57 of the printer 2 of this embodiment. The printer manufacturer typically sets "00", in the apparatus status recording memory 57 at the time of shipment from the manufacturing plant (at time of initial shipment). Then, the printer manufacturer enters into an agreement as shown below with the client, or the owner of the printer 2.

The manufacturer supplies low price toner cartridges to the proprietor of the printer 2.

The use of any improper toner cartridges is prohibited in the printer 2.

Then, 11 is typically set in the apparatus status recording memory 57 of the printer 2 owned by the client who has entered into such an agreement.

For this embodiment again, it is desirable that a special operation is required to rewrite the key information of the apparatus status recording memory 57 and it can be conducted only by the service person who takes care of the printer 2. For example, there may be a technique of setting the printer 2 so as to rewrite key information of the apparatus status recording memory 57 from a special connector on a board (not shown) of the printer 2, using a power supply voltage value that is not used in ordinary printers. When such a technique is employed, an exclusive onetime memory or a onetime region of an existing LSI may be used and the printer 2 may further be so set that the key information can be rewritten only once.

Beside the use of a port of a special controller as described above, it may alternatively be so arranged that the key information of the apparatus status recording memory 57 can be rewritten by utilizing a known port of an Ethernet interface or a USB interface.

Still alternatively, an RF-ID may be arranged for the apparatus status recording memory 57 so that the printer 2 can be rewritten wirelessly from the outside of the printer 2 by means of a special protocol or a cipher that only the manufacturer of the printer 2 knows. Once again, with such an arrangement, the printer 2 may further be so set that the key information can be irreversibly rewritten only once.

Still alternatively, the apparatus status recording memory 57 may be formed by using a fuse or some other part, which is meltdowned when the setting is changed from "00" to "11" because what is essential for the apparatus status recording memory 57 is that it stores "00" or "11". An apparatus status recording memory 57 formed by using a fuse or some other similar part makes the setting of the printer 2 inevitably irreversible.

For this embodiment, the consumable sales center 120 can rewrite the key information of the apparatus status recording memory 57 by way of the communication network 110 or the network 100. A known technique for upgrading the firmware of the printer 2 located at a remote site can be used to do the above operation.

It may be so arranged for this embodiment that an action of loading a low price toner cartridge in the printer 2 triggers rewriting the key information of the apparatus status recording memory 57. Such an arrangement can be realized by writing a program by which the key information of the apparatus status recording memory 57 is rewritten in ROM 52 when the engine control section 5 detects that a low price toner cartridge is loaded in the printer 2.

Now, the operation of the printer 2 based on the apparatus status recording memory 57 that is set in a manner as described above will be described below. FIG. 11 is a schematic illustration of the corresponding relationship between the setting of the apparatus status recording memory 57 of the embodiment and an operable toner cartridge and a limitedly operable toner cartridge.

According to the present invention, if the engine 6 of the printer 2 can be operated normally or only limitedly is determined according to the corresponding relationship between the setting of the apparatus status recording memory 57 of the printer 2 and the toner cartridge loaded in the printer 2.

Any known technique may be used to detect an improper toner cartridge in the printer 2 of this embodiment.

When the printer 2 is shipped from the manufacturing plant of the manufacturer, the apparatus status recording memory 57 is set to "00". This means that the engine 6 can operate normally when an ordinary toner cartridge is loaded in the printer 2 but operate only limitedly when a low price toner cartridge is loaded therein. On the other hand, when the client who purchased the printer 2 has entered into an agreement and the setting of the apparatus status recording memory 57 is rewritten so as to read "11", the engine 6 is disposed so as to operate normally regardless if an ordinary toner cartridge is loaded or a low price toner cartridge is loaded in the printer 2 but only limitedly when an improper toner cartridge is loaded in the printer 2.

Figure 12:
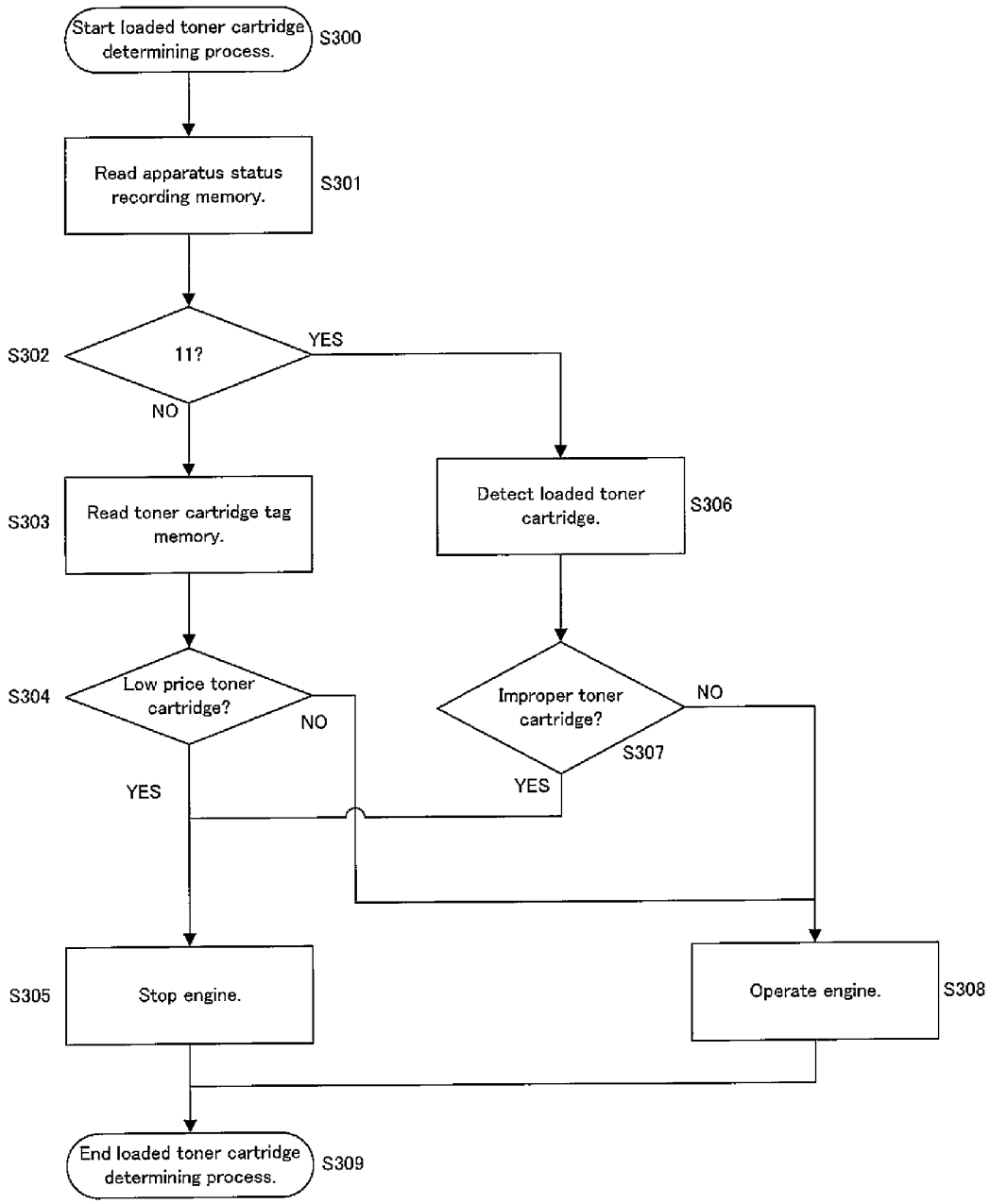
FIG. 12 is a control flowchart of the engine control section 5 of the printer 2 of the embodiment of FIG. 9.

Now, the operation of engine control sections that responds to a loaded toner cartridge will be described below. FIG. 12 is a control flowchart of the engine control section 5 of the printer 2 of this embodiment.

Referring to the flowchart of FIG. 12, as the loaded toner cartridge determination process is started in Step S300, the control section 5 proceeds to the next step, or Step S301, where it reads the value stored in the apparatus status recording memory 57. Subsequently, in Step S302, it is determined if the read value is "11" or not. If it is determined that the read value is "11" (YES), the control section 5 proceeds to Step S306.

In Step S306, the controller section 5 detects the type of the toner cartridge loaded in the printer 2. Any known toner cartridge detecting technique may be used for the detection of the type of the toner cartridge.

Then, in Step S307, it is detected if the toner cartridge loaded in the printer 2 is an improper toner cartridge or not. If the determination in Step S307 is NO, the control section 5 proceeds to Step S308, where it operates the engine 6, and then to Step S309 to end the process.

If, on the other hand, the determination in Step S307 is YES, the control section 5 proceeds to Step S305, where it stops the engine 6, and then to Step S309 to end the process.

If NO is determined in Step S302, the control section 5 proceeds to Step S303, where it reads the tag memory of the toner cartridge 611. As described above, the tag memory stores information that tells if the toner cartridge is an ordinary toner cartridge or a low price toner cartridge.

Then, the control section 5 proceeds to Step S304. In Step S304, it is determined if the loaded toner cartridge is a low price toner cartridge or not. If NO is determined in Step S304, the control section 5 proceeds to Step S308, where it operates the engine 6, and then to Step S309 to end the process.

If, on the other hand YES is determined in Step S304, it means that a low price toner cartridge is loaded although the printer 2 belongs to a user who has not entered into such an agreement. Therefore, the control section 5 proceeds to Step S305, where it stops the engine 6, and then to Step S309 to end the process.

As described above, according to the present invention, there is provided an image forming apparatus that can be so set as to allow or not to allow a low price toner cartridge to operate with it. Additionally, this embodiment is realized by taking any possible use of improper toner cartridges into consideration so that the sales strategy of providing low price toner cartridges is more effective.

While the consumable of a printer is toner cartridge in the above description, the present invention is applicable to any consumable cartridges filled with a recording material that can be used for image forming apparatus. For example, the present invention is applicable to an ink-jet type printer and ink cartridges that are consumable of the ink-jet type printer.

Additionally, while printers are described as embodiments of image forming apparatus according to the present invention, the present invention is applicable to image forming apparatus and consumables to be used in such the image forming apparatus. For example, the present invention is applicable to image forming apparatus of types other than printers such as electrophotographic copying machines, electrophotographic facsimile machines, electrophotographic composite machines, ink-jet type printers, ink-jet type facsimile machines and ink-jet type composite machines While the present invention is described above in terms of the first embodiment, the second embodiment and the third embodiment, the scope of the present invention includes embodiments realized by appropriately combining some of the components of those embodiments.

While the underlying concept of the present invention is expressed as "an image forming apparatus" and "a method of setting an image forming apparatus", it includes conceptual elements applicable to business model such as "a method of selling consumables" and "a method of selling image forming apparatus" and hence the present invention is applicable to such categories.

What is claimed is:

1. An image forming system, comprising:

a consumable cartridge for an image forming apparatus that includes a tag memory and stores information in the tag memory as to whether the consumable cartridge is a ordinary consumable cartridge or a low price consumable cartridge; and an image forming apparatus in which the consumable cartridge for an image forming apparatus is loaded, wherein the image forming apparatus can take two forms, one of which is a low price consumable cartridge disabled image forming apparatus which cannot use the low price consumable cartridge, and the other of which is a low price consumable cartridge enabled image forming apparatus which can use the low price consumable cartridge, the low price consumable cartridge disabled image forming apparatus can be irreversibly shifted to the low price consumable cartridge enabled image forming apparatus, the low price consumable cartridge disabled image forming apparatus can operate properly at the time when the ordinary consumable cartridge is loaded and can operate limitedly when the low price consumable cartridge is loaded, and the low price consumable cartridge enabled image forming apparatus can operate properly in both cases when the ordinary consumable cartridge is loaded and when the low price consumable cartridge is loaded.

2. The image forming system according to claim 1, wherein the low price consumable cartridge disabled image forming apparatus is shifted to the low price consumable cartridge enabled image forming apparatus according to an agreement with the proprietor of the image forming apparatus.

3. An image forming system, comprising:

a consumable cartridge for an image forming apparatus that includes a tag memory and stores information in the tag memory as to whether the consumable cartridge is a ordinary consumable cartridge or a low price consumable cartridge;

and an image forming apparatus, in which the consumable cartridge for an image forming apparatus is loaded, that is supplied by a same manufacturer as that of the consumable cartridge for an image forming apparatus, wherein the image forming apparatus can take two forms, one of which is a low price consumable cartridge disabled image forming apparatus which cannot use a low price consumable cartridge, and the other of which is a low price consumable cartridge enabled image forming apparatus which can use the low price consumable cartridge, the low price consumable cartridge disabled image forming apparatus can be irreversibly shifted to the low price consumable cartridge enabled image forming apparatus, the low price consumable cartridge disabled image forming apparatus can operate properly at the time when a ordinary consumable cartridge is loaded and can operate limitedly when a low price consumable cartridge is loaded, and the low price consumable cartridge enabled image forming apparatus can operate without limitation in both cases when the ordinary consumable cartridge is loaded and when the low price consumable cartridge is loaded.

4. The image forming system according to claim 3, wherein the manufacturer processes to shift the low price consumable cartridge disabled image forming apparatus to the low price consumable cartridge enabled image forming apparatus according to an agreement between the manufacturer and the proprietor of the image forming apparatus.

* * * * *